US006107583A

United States Patent [19]

Berfield

[11] Patent Number: 6,107,583

[45] Date of Patent: Aug. 22, 2000

[54] SWITCH ASSEMBLY HAVING AN ENLARGED ACTUATION SURFACE

[75] Inventor: Robert C. Berfield, Jersey Shore, Pa.

[73] Assignee: Shop Vac Corporation, Williamsport, Pa.

[21] Appl. No.: 09/369,630

[22] Filed: Aug. 6, 1999

[51] Int. Cl.[7] ..... H01H 13/06

[52] U.S. Cl. ..... 200/302.2; 200/408

[58] Field of Search ..... 200/302.2, 329, 200/333, 339, 401, 438, 439, 553, 557, 408, 409, 6 R

[56] References Cited

U.S. PATENT DOCUMENTS

| | | | |
|---|---|---|---|
| 2,984,725 | 5/1961 | Hubbell et al. . | |
| 3,931,487 | 1/1976 | Russenberger . | |
| 4,119,823 | 10/1978 | Matsueda et al. . | |
| 4,814,566 | 3/1989 | Sigl | 200/305 |
| 5,380,968 | 1/1995 | Morse . | |
| 5,760,356 | 6/1998 | Garcia et al. . | |
| 5,765,258 | 6/1998 | Melito et al. . | |
| 5,788,059 | 8/1998 | Jahangiri . | |
| 5,990,431 | 11/1999 | Wright | 200/302.3 |

FOREIGN PATENT DOCUMENTS

| | | |
|---|---|---|
| 2253263 | 11/1973 | France . |
| 1956502 | 11/1969 | Germany . |

*Primary Examiner*—Michael L. Gellner
*Assistant Examiner*—Nhung Nguyen
*Attorney, Agent, or Firm*—Marshall, O'Toole, Gerstein, Murray & Borun

[57] ABSTRACT

A switch assembly having an enlarged actuation surface and enhanced tactility is provided. The switch assembly may include a switch having a movable switch mounted within a recess. The actuation surface may be an elongate planar body loosely held within the recess and in engagement with the movable switch. A flexible protective cover may be provided over the recess, switch and actuation surface. The planar body increases the actuation area of the switch assembly without increasing the size, and accompanying cost, of the switch.

20 Claims, 4 Drawing Sheets

SWITCH ASSEMBLY HAVING AN ENLARGED ACTUATION SURFACE

FIELD OF THE INVENTION

The present invention generally relates to switches and, more particularly, to switch assemblies including an electrical switch enclosed within a protective cover.

BACKGROUND OF THE INVENTION

Electric tools and appliances often utilize rocker switches which may be positionable in a single stable state or multiple stable states. In the case of a bistable rocker switch, a rocker arm is movable between a first stable position, at which the switch is open and the tool or appliance is deactuated, and a second stable position, at which the switch is closed to apply power and actuate the tool or appliance.

When such switches are provided on power tools, including vacuum cleaners, the switches are often exposed to relatively harsh physical environments. For example, the switch may be subjected to moisture, extreme temperature ranges, chemical contaminants, and particulate matter such as dust, dirt and the like. It is therefore common for such switches to be enclosed within a protective cover typically manufactured from an elastomeric material such as silicone rubber. The elastomeric cover not only facilitates deformation to allow actuation of the switch, but also provides sealing properties which substantially prevent contaminants from accessing the switch. Examples of switch and protective cover assemblies are provided in U.S. Pat. Nos. 2,984,725; 5,380,968; and 5,788,059; as well as German Patent No. 1,956,502.

It is desirable to utilize a switch which can be easily manipulated by a user. However, this course of operation is typically thought of as being afforded only by a switch having a relatively large rocker arm. Such a large switch would undesirably add to the cost of the device in which it is used.

SUMMARY OF THE INVENTION

In accordance with one aspect of the present invention, a switch assembly is provided which may include a switch having a movable switching element disposed in a recess, a flexible cover disposed over the recess, and an actuation member loosely disposed in the recess and separate from the switching element. The actuation member is engageable with the switching element in response to an applied force to assist in moving the switching element.

Preferably, the switching element may be movable between two stable states. Also preferably,, the actuation member may comprise a planar body, and the planar body may include rounded ends.

In accordance with another aspect of the present invention, a switch assembly is provided which may include a rocker switch operable between first and second positions, a rigid actuation surface loosely positioned over the rocker switch, and a flexible cover mounted over the rocker switch and the rigid actuation surface.

In accordance with yet another aspect of the present invention, a switch assembly is provided which may include a switch adapted to be moved between first and second positions, and a rigid, planar actuation member positioned atop the switch. The switch may have an operable surface with a first surface area against which force may be applied to move the switch between the first and second positions, while the actuation member may have a second surface area against which force may be directed to move the switch between the first and second positions, with the second surface area being larger than the first surface area.

In accordance with a still further aspect of the present invention, a method of operating a switch is provided which may include the steps of providing a switch movable between first and second positions, positioning a rigid, planar actuation member atop the switch, the actuation member having first and second ends, and depressing one of the first and second ends of the actuation member to move the switch between one of the first and second positions.

These and other aspects and features of the invention will become more apparent from the following detailed description in conjunction with the accompanying drawings.

DETAILED DESCRIPTION OF THE PREFERRED EMBODIMENTS

Figure 1:
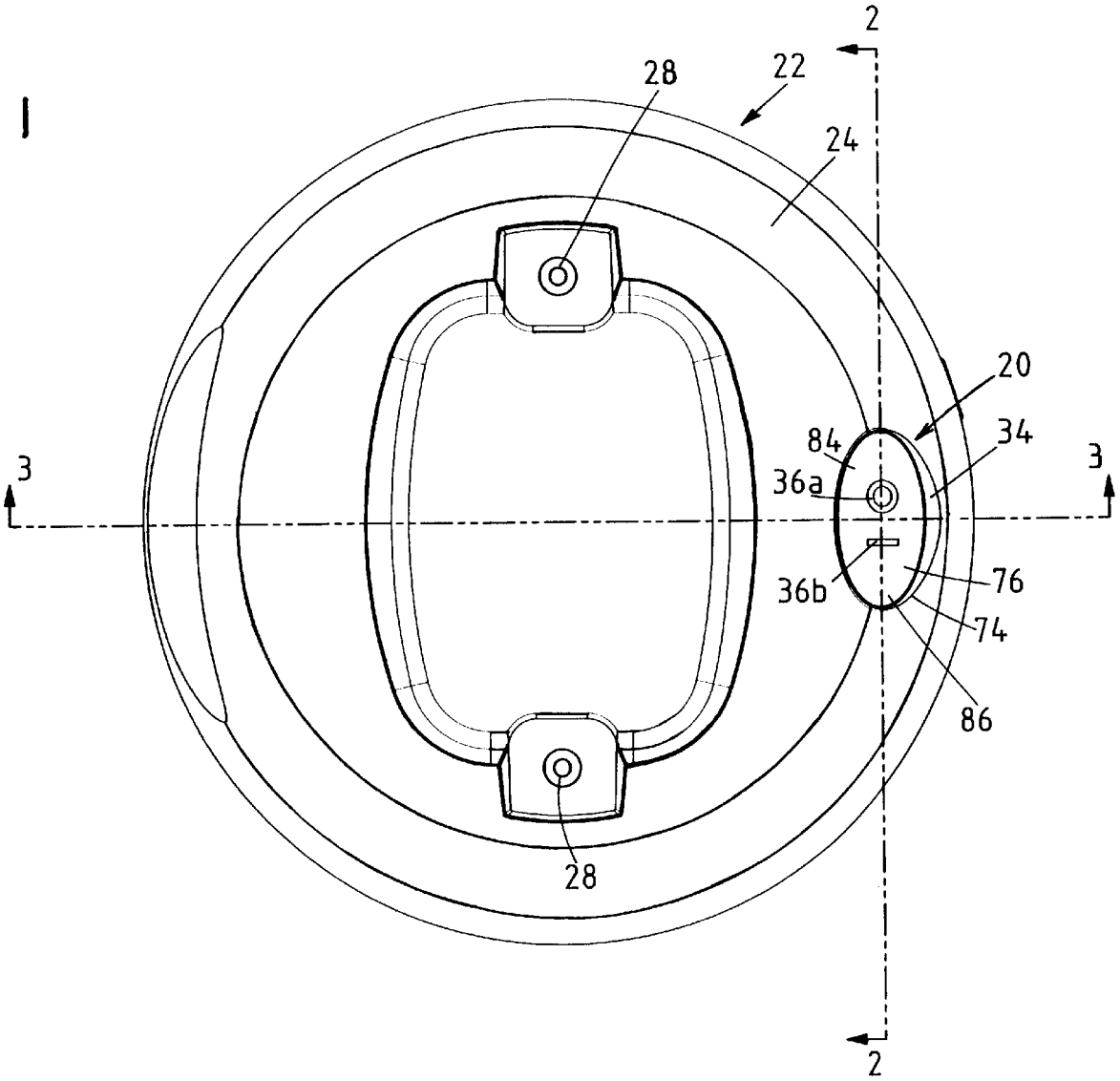
FIG. 1 is a plan view of a wet/dry vacuum cleaner housing assembly employing a switch assembly in accordance with the present invention.

Referring now to the drawings, and with specific reference to FIG. 1, a switch assembly in accordance with the present invention is generally depicted by reference numeral 20. While the switch assembly 20 is shown as forming a part of a housing assembly 22 of a wet/dry vacuum cleaner (not shown), it is to be understood that the switch assembly 20 may be employed in a variety of switching applications wherein improved tactility and enlarged switch actuation surfaces are desirable.

Figure 2:
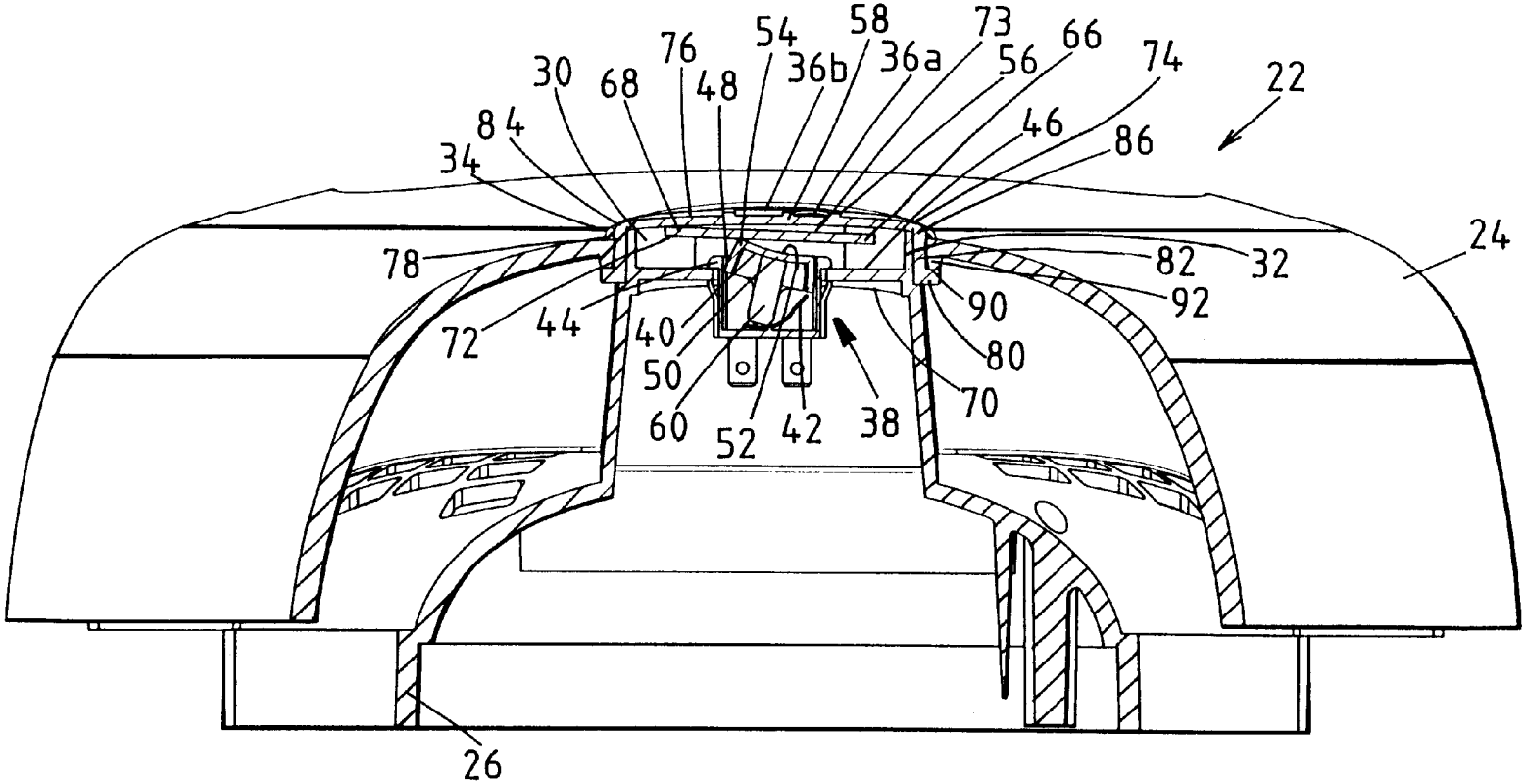
FIG. 2 is a sectional view of the vacuum cleaner housing assembly of FIG. 1 taken generally along lines 2—2 of FIG. 1.
Figure 3:
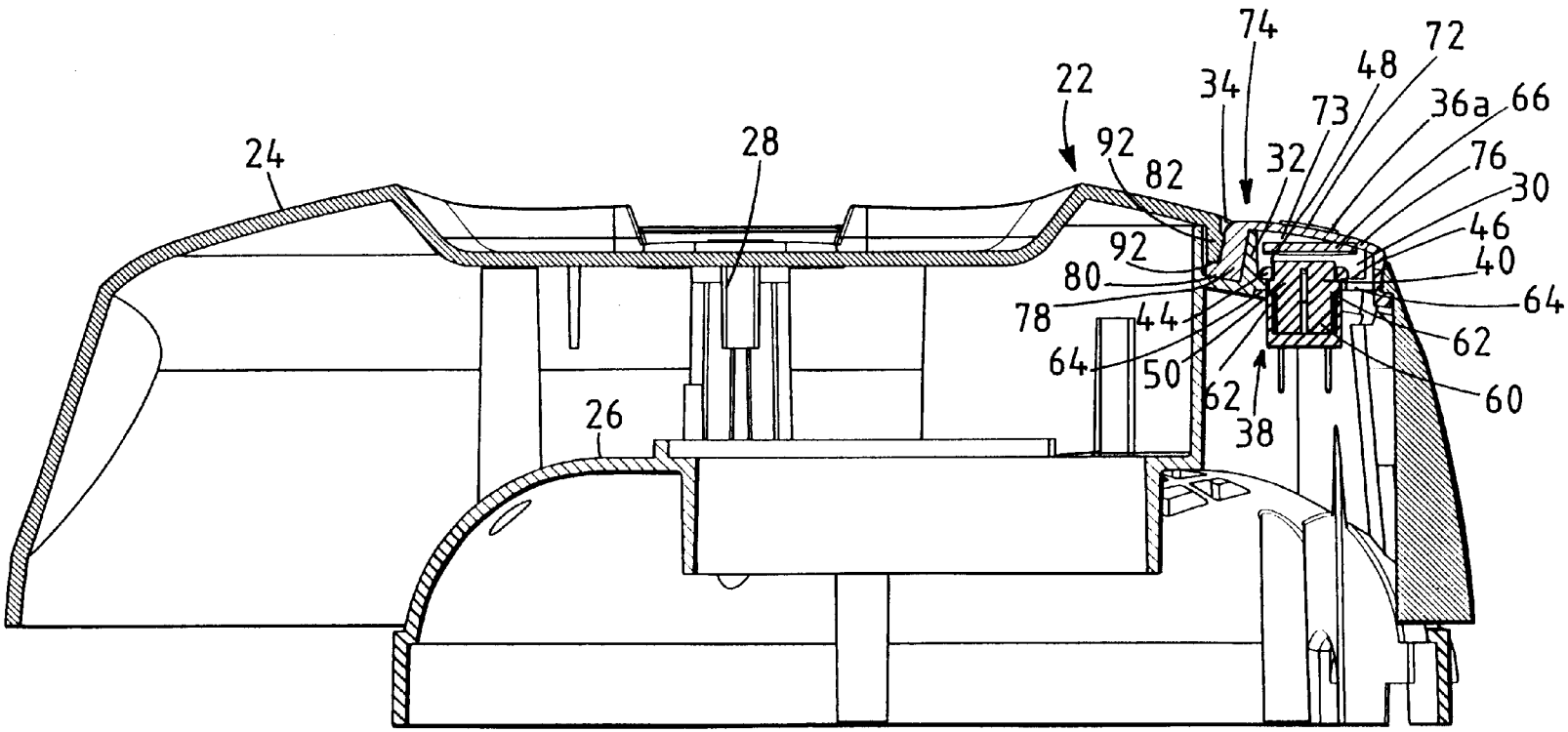
FIG. 3 is sectional view of the industrial vacuum cleaner hood of FIG. 1 taken generally along lines 3—3 of FIG. 1.

As shown best in FIGS. 2 and 3, the housing assembly 22 may include a housing cover 24 attached to a baffle 26. As seen in FIG. 1, the housing cover 24 is attached to the baffle 26 by suitable fasteners 28, such as screws or the like. The switch assembly 20 is disposed within a recess 30 defined by a raised wall 32 which extends upwardly through an opening 34 in the housing cover 24. The user of the electrical device is only able to see the housing cover 24, with the switch assembly 20 protruding therethrough. The switch assembly 20 is provided with suitable markings 36*a*, 36*b* to facilitate use by an operator in turning the device on and off.

The switch assembly 20 includes a switch 38 having a switching element 40 which is movable between first and second positions. It will be readily understood that in the preferred embodiment the first and second positions of the switch 38 correspond to on and off positions for the electric device. In the first or on position an electrical contact 42 (FIG. 2) is depressed to close a circuit, and in the second or off position the electrical contact 42 is not depressed and the circuit is therefore open. Such a switch 38 is conventionally referred to as a rocker switch or a bi-stable rocker switch in that two stable positions are achievable with the switch. However, it should be realized that the present invention is useful with other types of switches, such as rocker switches which have a number of stable positions other than two.

To facilitate movement of the switch 30 between positions, the switching element 40 is pivotally mounted in a mounting frame 44. The mounting frame 44 is provided in a bottom ledge 46 of the recess 30. The mounting frame 44 defines an opening 48 through which the switching element 40 protrudes. More specifically, as shown in FIG. 2, the switching element 40 includes a main actuator body 50 disposed within the mounting frame 44. An upper surface 52 of the main body 50 is arcuate and includes first and second peaks 54 and 56. A lower surface 58 of the main body 50 includes an actuator tongue 60 sufficiently long to engage the contact 42.

Upon depression of one of the peaks 54 and 56, the main body 50 pivots within the mounting frame 44, which accordingly causes the switching element 40 to swing in arcuate fashion from the first position to the second position, or vice versa. As shown in FIG. 3, the main body 50 preferably includes pivot stubs 62 which are rotatably journalled within bearing apertures 64 provided in the mounting frame 44 to facilitate movement of the switching element 40 between positions.

Figure 4:
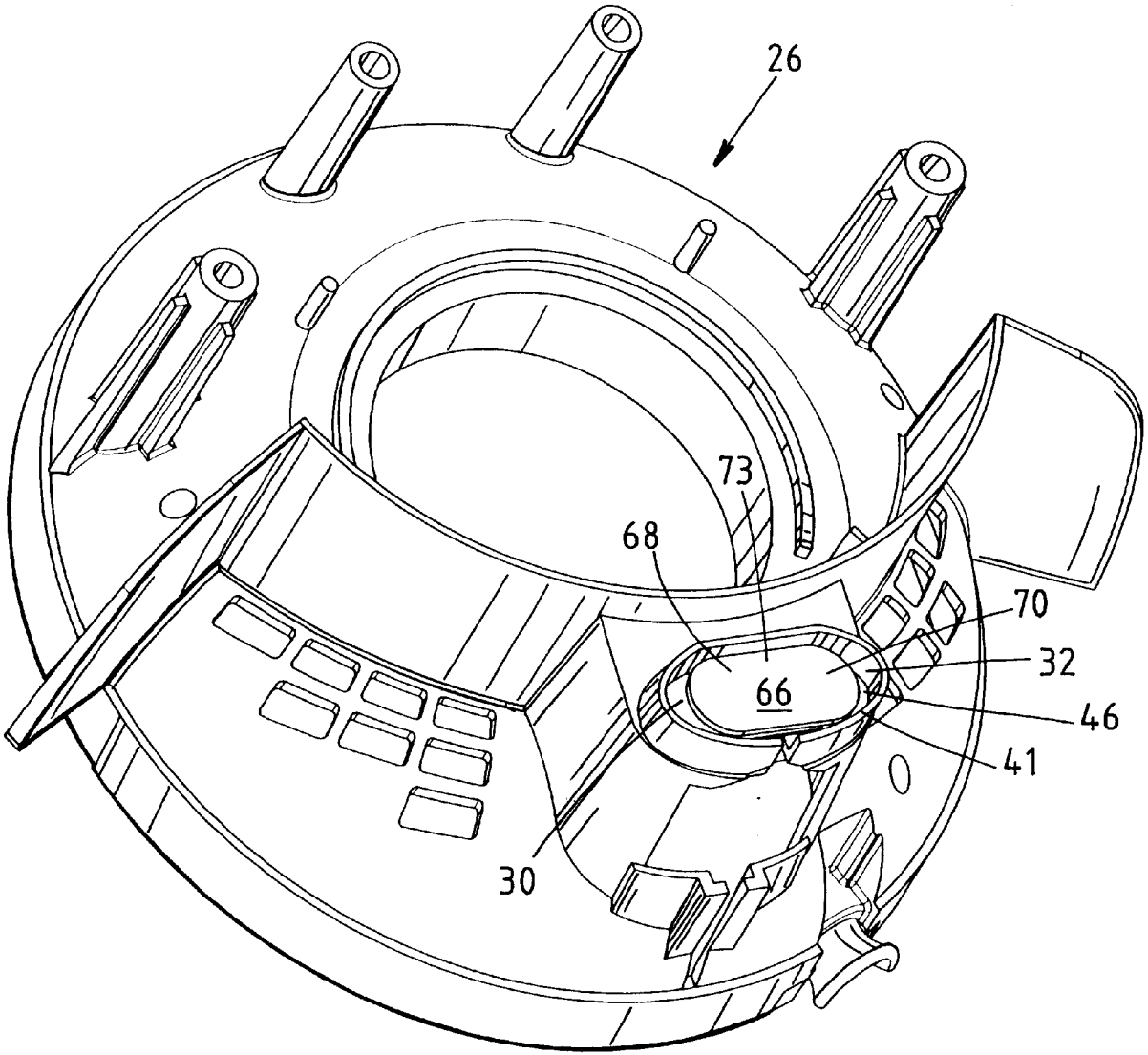
FIG. 4 is a perspective view of a baffle of the housing assembly depicting a switch recess having an actuation surface loosely held within the switch recess While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the invention is to cover all modifications, alternative constructions, and equivalents falling within the spirit and scope of the invention as defined by the appended claims.

In order to enlarge the operable surface of the switch assembly 20 without increasing the size of the switch 38, the present invention preferably comprehends the use of an actuation member 66 proximate the switch 38. More specifically, the actuation member 66, as shown best in FIG. 4, may be substantially planar, and in the shape of an elongate oval. In the preferred embodiment, the actuation member 66 includes first and second rounded ends 68 and 70 sized and shaped to at least roughly match the oval shape of the recess 30. The actuation member 66 is preferably manufactured from a rigid, or semi-rigid, material such as polycarbonate plastic.

The actuation member loosely rests within the recess 30 atop the switch upper surface 52 and is preferably separate from the upper surface 52. In the preferred embodiment, the actuation member 66 is sized such that a lower surface 72 of the actuation member 66 rests against one of the peaks 54 and 56, the particular peak being the one which happens to be disposed higher at the time. If desired, the actuation member 66 may be smaller to permit the actuation member 66 to be in contact with both peaks 54, 56 at any particular time. From FIGS. 2 and 4 it can be readily discerned that the area of a top surface 66 of the actuation member is preferably considerably (although not necessarily) larger than the area of the upper surface 52 of the switch 38. Therefore, the effective operable area of the switch assembly 20 is greatly increased without increasing the size of the switch 38, which not only facilitates operation of the switch assembly 20, but minimizes cost as well in that the use of a larger, more expensive, switch is avoided.

Referring to FIGS. 1–3, a protective cover 74 is positioned over the switching element 40 and the actuation member 66. The protective cover 74 is flexible and preferably manufactured from silicone rubber, although other flexible materials can be employed with similar efficacy. The protective cover 74 includes a top 76 which is slightly arcuate in cross-sectional shape, and an annular side wall 78 downwardly depending therefrom at a substantially orthogonal angle. An annular flange 80 radially extends from a base 82 of the side wall 78. The top 76 includes first and second ends 84 and 86.

As shown best in FIG. 2, the sidewall 78 protrudes through an opening 88 in the housing cover 24, with the flange 80 engaging an underside 90 of a downwardly depending lip 92 of the housing cover 24. In so doing the sidewall 78 engages the raised wall 32 in sealing fashion, covering the actuation member 66 and the switch 38.

In operation, it can be seen that an operator is able to move the switch assembly 20 between on and off positions by depressing one of the first or second ends 84 and 86 of the protective cover 74. By depressing and deforming the protective cover 74, the actuation member 66 loosely provided beneath the protective cover 74 is depressed as well. The actuation member 66 in turn imparts force against one of the peaks 54 and 56 of the switching element 40 to cause the switching element 40 to pivot about stubs 62 journalled within the mounting frame 44. Pivoting of the switching element 40 causes an actuation tongue 60 attached thereto to arcuately move and depress or not depress an electrical contact 42, and thus close or not close a circuit. The top surface 76 of the protective cover 74 provides a relatively large operative area for the operator thereby facilitating use, without increasing the size of the switch 30 and thereby minimizing costs.

From the foregoing in can therefore be seen that the invention provides an improved switch assembly having enhanced tactility and an enlarged operable area, while doing so with a conventionally sized switch.

What is claimed is:

1. A switch assembly, comprising:

a switch having a movable switching element disposed in a recess;

a flexible cover disposed over the recess; and an actuation member loosely disposed in the recess and separate from the switching element wherein the actuation member is engageable with the switching element in response to an applied force to assist in moving the switching element.

2. The switch assembly of claim 1, wherein the switching element is movable between two stable states.

3. The switch assembly of claim 1, wherein the actuation member comprises a planar body.

4. The switch assembly of claim 3, wherein the planar body includes rounded ends.

5. The switch assembly of claim 1, wherein the switch has an engageable surface having a first area and the actuation member has an engageable surface having a second area, the second area being larger than the first area.

6. The switch assembly of claim 1, wherein the flexible cover includes markings for use by an operator of the switch assembly.

7. The switch assembly of claim 1, wherein the flexible cover is manufactured from silicone rubber, and the actuation member is manufactured from rigid plastic.

8. A switch assembly, comprising:

a rocker switch operable between first and second positions;

a rigid actuation surface loosely positioned over the rocker switch; and a flexible cover mounted over the rocker switch and the rigid actuation surface.

9. The switch assembly of claim 8, wherein the rigid actuation surface is substantially planar.

10. The switch assembly of claim 8, wherein the rocker switch has a first operable surface area and the rigid actuation surface has a second operable surface area, the second operable surface area being larger than the first operable surface area.

11. The switch assembly of claim 8, further including a baffle having a recess, the rocker switch and actuation surface being mounted in the recess, the flexible cover being mounted over the recess to substantially seal the rocker switch from contaminants.

12. The switch assembly of claim 11, wherein the baffle forms part of a hood for a wet/dry vacuum cleaner.

13. A switch assembly, comprising:

a switch movable between first and second positions, the switch having an operable surface with a first surface area against which force is applied to move the switch between the first and second positions; and a rigid, planar actuation member positioned atop the switch, the actuation member having a second surface area against which force is directed to move the switch between the first and second positions, the second surface area being larger than the first surface area.

14. The switch assembly of claim 13, further including a flexible cover positioned over the switch and actuation member.

15. The switch assembly of claim 14, wherein the switch is mounted within a recess having a raised wall, the actuation member is loosely disposed on top of the switch within the raised wall of the recess, and the flexible cover is positioned over and around the raised wall to substantially seal the switch from contaminants.

16. The switch assembly of claim 15, wherein the recess and raised wall are part of a housing cover for a wet/dry vacuum cleaner.

17. A method of operating a switch, the method comprising the steps of:

providing a switch movable between first and second positions, the switch having a first engageable surface;

loosely positioning a rigid, planar actuation member atop the switch, the actuation member having a second engageable surface with first and second ends; and depressing one of the first and second ends of the actuation member to move the switch between one of the first and second positions.

18. The method of operating a switch of claim 17, wherein the providing step further includes the step of providing a recess having a raised wall and providing the switch within the recess, and the positioning step includes the step of loosely positioning the actuation member within the recess and inside of the raised wall.

19. The method of operating a switch of claim 18, further including the step of mounting a flexible cover over the raised wall, and wherein the depressing step includes the step of depressing the flexible cover to depress the actuation member.

20. The method of operating a switch of claim 17, wherein the area of the second engageable surface is larger than the area of the first engageable surface.

* * * * *